United States Patent [19]

Jochum

[11] 4,138,788

[45] Feb. 13, 1979

[54] EXPLOSIVE POWDER OPERATED SETTING DEVICE

[75] Inventor: Peter Jochum, Meiningen, Austria

[73] Assignee: Hilti Aktiengesellschaft, Schaan, Liechtenstein

[21] Appl. No.: 881,812

[22] Filed: Feb. 27, 1978

[30] Foreign Application Priority Data

Mar. 14, 1977 [DE] Fed. Rep. of Germany ..... 2711070

[51] Int. Cl.[2] ..... B25C 1/14

[52] U.S. Cl. ..... 42/1 R; 227/10

[58] Field of Search ..... 42/1 R, 1 M; 89/1 B, 89/1 R, 26; 227/9, 10

[56] References Cited

U.S. PATENT DOCUMENTS

| | | | |
|---|---|---|---|
| 3,283,657 | 11/1966 | Kvavle | 42/1 R |
| 3,296,728 | 1/1967 | Kvavle | 42/1 R |
| 3,688,964 | 9/1972 | DeCaro | 227/10 |
| 3,777,382 | 12/1973 | Brunelle | 42/1 R |
| 4,063,672 | 12/1977 | Jochum | 227/10 |

*Primary Examiner*—Charles T. Jordan

*Attorney, Agent, or Firm*—Toren, McGeady, Stander

[57] ABSTRACT

In an explosive powder operated device using caseless powder charges for firing fastening elements into a hard receiving material, the firing chamber in the barrel of the device is defined in part by one end of a counterhammer. The one end includes a sealing ring having a frusto-conical sealing surface supported on a correspondingly shaped surface on an axially extending body part of the counterhammer. When a caseless charge is ignited in the firing chamber, the explosive gases generated act in direct surface contact on at least a portion of the sealing ring which faces into the firing channel.

9 Claims, 2 Drawing Figures

EXPLOSIVE POWDER OPERATED SETTING DEVICE

SUMMARY OF THE INVENTION

The present invention is directed to an explosive powder operated setting device for driving bolts, studs and other fastening elements, into a hard receiving material, such as concrete, and, more particularly, it concerns a counterhammer which forms a part of the firing chamber in the device and the counterhammer also feeds caseless powder charges into the firing chamber.

In explosive powder operated setting devices using caseless powder charges, there has been the problem of sealing the firing chamber to attain optimum driving power. Explosive gases generated during the ignition of the caseless charge tend to escape, because of the high pressures developed, through the smallest gap in the sealing means with a resultant reduction in the driving power of the setting device. In addition, the explosive gases escape at a high temperature which could lead to serious injuries to the person operating the setting device.

These problems occur especially in setting devices having a cone-shaped counterhammer which feeds the caseless charges into the firing chamber. The required operating play already present in such devices increases during use because of mechanical wear and the leakage of explosive gases also increases.

Previously, in such setting devices it has been attempted to provide adequate sealing by using a cartridge case having a thin wall thickness. This attempted solution did not provide the desired results, however, because the cartridge case became radially enlarged due to the pressure of the explosive gases and the resulting play relative to the counterhammer became larger.

In another known setting device, the shaft of the counterhammer is provided with individual pressure release grooves intended to effect a better sealing action by a step-wise reduction in the pressure gradient. This measure has not been sufficient, since significant explosive gas losses still occurred.

In yet another known setting device, the cone-shaped counterhammer was provided with a circular groove containing a sealing ring. This arrangement corresponds to the use of so-called O-rings employed for sealing pistons and slides. This type of sealing closure is not practical in explosive powder operated setting devices, however, because of the high temperatures and pressures which develop.

Therefore, the primary object of the present invention is to provide an optimum and permanent sealing closure for a cone-shaped counterhammer used for feeding caseless powder charges into the firing chamber of an explosive powder operated setting device.

In accordance to the present invention, the end of the counter hammer directed toward the firing chamber supports a sealing ring. Positioning the sealing ring at this location assures that the explosive gases act only on the end of the counterhammer directed toward the firing chamber. As a result, the explosive gases cannot reach the axially extending surfaces of the counterhammer and wear on such surfaces is extremely low. Furthermore, particles of the caseless charge cannot penetrate into the space around the counterhammer avoiding the problem which previously existed when such particles were ignited in the gap and caused damage to the setting device.

To afford optimum sealing of the counterhammer, it is advantageous if the radially inner surface of the sealing ring has a frusto-conical surface diverging in the direction away from the firing chamber. This frusto-conical sealing surface on the ring seats against a correspondingly shaped surface on the body of the counterhammer. Due to the action of the explosive gases when a caseless charge is ignited, the sealing ring with its frusto-conical sealing surface is pressed against the correspondingly shaped surface on the counterhammer. At the same time, the sealing ring is radially enlarged as it is forced onto the frusto-conical surface of the counterhammer body. Differences in diameter, such as those caused by wear, are compensated by the plastic deformation of the sealing ring. It is particularly advantageous if the sealing ring is formed of an elastically deformable material with plastic fatigue stretching. Certain steels are particularly useful for this purpose, but other metals such as aluminum, copper, brass and others can be used.

Since it is subject to wear during operation of the setting device, the sealing ring must be replaced after a period of time. To simplify replacement of the sealing ring, it is advantageous if it is secured onto the end of the counterhammer by a mushroom-shaped retaining member. The retaining member can be threaded into the counterhammer or it may be attached to it by an appropriate interengaging fit. The retaining member, however, should be formed so that at least a portion of the sealing ring is directly exposed to the explosive gases generated in the firing chamber. Such exposure can be afforded by providing grooves through the surface of the retaining member facing the firing chamber with the grooves opening to the surface of the sealing ring. In another arrangement, the rearward end of the sealing ring can be provided with a jacket-like elongation so that it is unnecessary to exchange the entire counterhammer when due to wear such replacement is necessary. When the play between the counterhammer and its enclosing passage becomes too large because of wear, the sealing ring and its jacket-like elongation can be replaced. This elongation of the sealing ring has the additional advantage that heat generated during the ignition of a caseless charge can be dissipated quickly and uniformly at the sealing ring.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figures 1, 2:
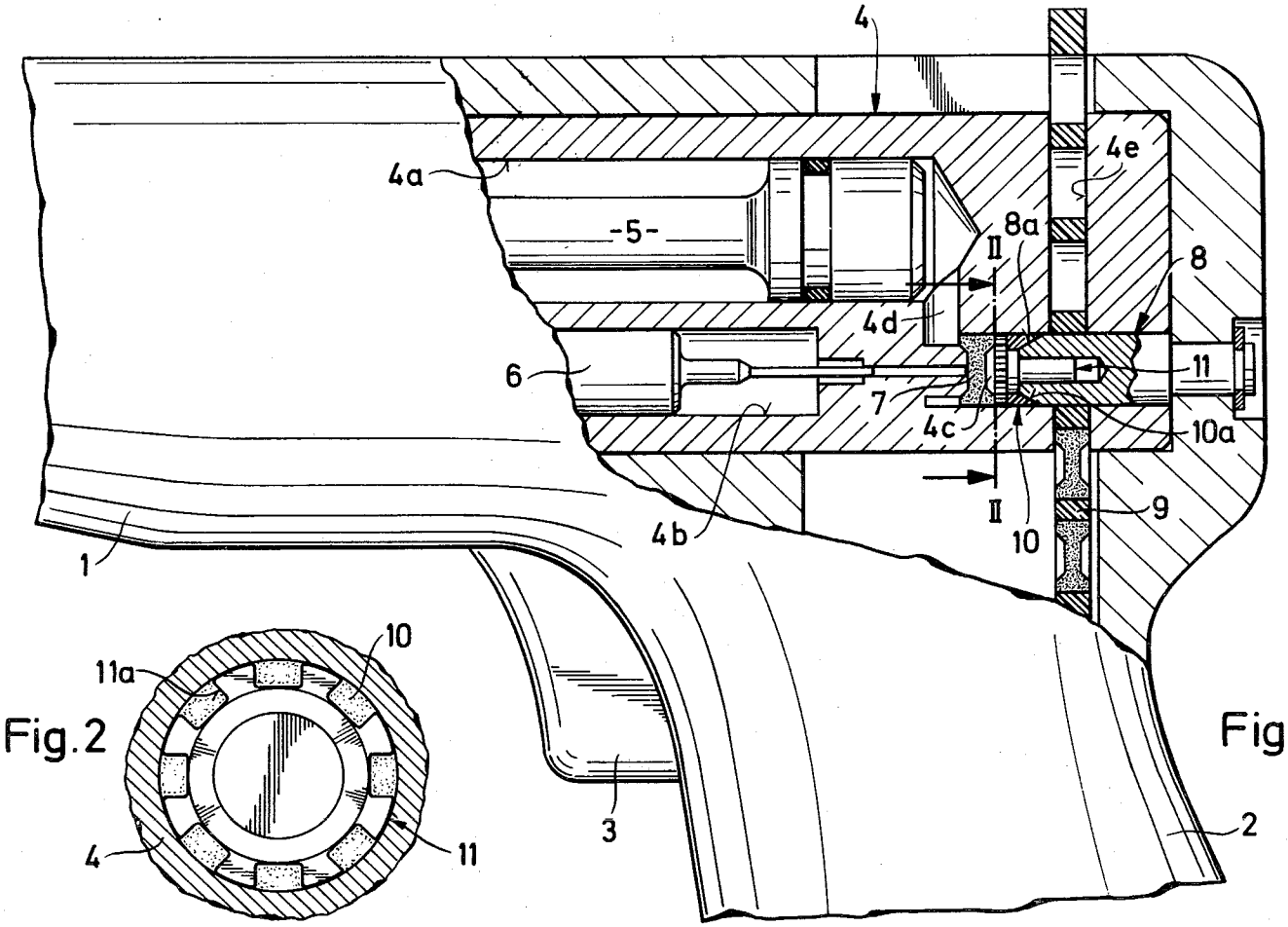
FIG. 1 is a side view, partly in section, of an explosive powder operated setting device embodying the present invention.
FIG. 2 is a partial sectional view of the device taken along the line II—II in FIG. 1.

In FIG. 1 a portion of an explosive powder operated setting device is illustrated and the device includes a housing 1 with a grip handle 2 extending downwardly from the rearward end of the housing. A trigger 3 is mounted in the grip handle. Axially movably mounted within the housing 1 is a barrel 4. Barrel 4 includes an axially extending bore 4a containing a driving piston 5 for propelling a fastening element from the bore into a hard receiving material, such as concrete and the like. Located in the barrel below the bore and parallel to it is a guide passage 4b. A firing pin 6 is movably supported in the guide passage 4b. In a rearward elongation of the guide passage 4b, within the rearward end, of the barrel is a firing chamber 4c. In FIG. 1, a caseless charge 7 is positioned in the firing chamber 4c. Explosive gases generated during the ignition of the caseless charge 7 flow through a connecting duct 4d in the barrel into the rearward end of the bore 4a and act on the rearward end of the driving piston 5 for propelling it forwardly through the bore. Rearwardly of the firing chamber 4c, on the opposite side of the caseless charge 7 from the ignition pin 6, a counterhammer 8 having a conically shaped surface is positioned in a passageway in the rear end of the barrel. Initially, the counterhammer 8 displaces caseless charges 7 from a magazine 9 positioned in a magazine duct 4e extending through the barrel transversely of its axial direction, into the firing chamber 4c. When the caseless charge 7 is ignited, the counterhammer 8 forms the rearward surface of the firing chamber 4c. The rearward extension of the firing chamber 4c is sealed by a sealing ring 10. The sealing action is provided by the end of the body of the counterhammer 8 facing toward the firing chamber which has a frusto-conical surface 8a against which the radially inner frusto-conical surface 10a of the ring 10. Both of the frusto-conical surfaces 8a and 10a diverge in the rearward direction and are formed in a complementary manner so that the sealing ring 10 interacts with the forward end of the body of the counterhammer 8 when a caseless charge is fired in the firing chamber 4c. Extending through the ring 10 from the firing chamber side into the body of the counterhammer is a mushroom-shaped retaining member 11. The retaining member includes a head which overlaps a portion of the end surface of the sealing ring 10 and a shank extending rearwardly from the head through the ring into the body of the counterhammer. As shown in FIG. 1, the shank of the retaining member 11 is pressed into a coaxial bore in the counterhammer 8. For the simple replacement of the sealing ring, however, the shank of the retaining member 11 can be threaded into the bore in the counter hammer 8. As is shown in FIG. 2, the surface of the head of the retaining member facing the firing chamber 4c overlaps or covers only a portion of the adjacent surface of the sealing ring 10 so that explosive gases generated during the firing of a caseless charge 7 act directly against the surface of the sealing ring facing into the firing chamber. The force generated by the explosive gases presses the sealing ring 10 axially rearwardly over the frusto-conical surface 8a causing radial enlargement of the sealing ring. This characteristic of the sealing ring provides for optimum sealing of the firing chamber 4c. When the pressure of the explosive gases in the firing chamber drops, the compression action on the sealing ring 10 is relaxed and the movement of the barrel 4 relative to the counterhammer 8 is facilitated. It can be noted that at its rearward end, the countermember is secured to the rear portion of the housing rearweardly of the barrel. The forward axial displacement of the barrel relative to the housing and the subsequent rearward movement of the barrel causes the counterhammer 8 to remove a caseless charge 7 from the magazine 9 in the duct 4e and move the charge forwardly into the firing chamber 4c.

FIG. 2 illustrates in partial section that portion of the device indicated by the line II—II. In particular, the head of the retaining member 11 is illustrated. Around the circumferential periphery of the head, grooves 11a extending in the axial direction of the countermember, are provided. These grooves 11a are spaced angularly apart by outwardly extending projections on the head. By virtue of the grooves 11a the explosive gases generated in the firing chamber can flow through the grooves into direct contact with the exposed surfaces of the sealing ring 10. However, instead of grooves 11a, an annular gap could be provided about the circumferential periphery of the head of the retaining member 11 exposing the radially outer portion of the end surface of the sealing ring directed toward the firing chamber.

While specific embodiments of the invention have been shown and described in detail to illustrate the application of the inventive principles, it will be understood that the invention may be embodied otherwise without departing from such principles.

I claim:

1. An explosive powder operated device for setting fastening elements, such as bolts, studs and the like into a hard receiving material, comprising a housing, a barrel mounted in said housing and having a forward end and a rearward end, said barrel having an axially extending bore from which fastening elements are driven from the forward end of said barrel into the receiving material, a firing chamber within said barrel arranged to supply explosive gases into said bore, a counterhammer mounted in said barrel for feeding caseless powder charges into said firing chamber and said counterhammer forming one of the end faces of said firing chamber, wherein the improvement comprises that said counterhammer includes an axially extending body having an axially extending surface and an end surface extending transversely of the axially extending surface and located adjacent to said firing chamber, and a sealing ring supported on said end surface and located between the end surface and said firing chamber.

2. An explosive powder operated device, as set forth in claim 1, wherein at least a portion of said end surface facing toward said firing chamber is frusto-conically shaped with the frusto-conical portion diverging in the axial direction of said body away from said firing chamber, and said sealing ring having a radially inwardly directed frusto-conically shaped sealing surface shaped complementary to and in sealing engagement with the frusto-conically shaped portion of said end surface.

3. An explosive powder operated device, as set forth in claim 2, wherein said counterhammer includes a member secured to said body and comprising a head positioned between said sealing ring and said firing chamber and securing said sealing ring onto said end surface on said body.

4. An explosive powder operated device, as set forth in claim 3, wherein said member including a shank part projecting in the axial direction of said body from said head through said sealing ring into said body, said head extending transversely of said shank and overlapping at least a portion of the surface of said sealing ring facing toward said firing chamber.

5. An explosive powder operated device, as set forth in claim 4, wherein said barrel having a passage therein spaced laterally from said barrel and extending rearwardly from said firing chamber to the rearward end of said barrel, said counterhammer being movably displaceably mounted in said passage and being secured to said housing rearwardly of said barrel.

6. An explosive powder operated device, as set forth in claim 5, wherein the forward end of said passage defines the opposite end face of said firing chamber from said counterhammer and the lateral surfaces of said firing chamber extending between the end surfaces thereof.

7. An explosive powder operated device, as set forth in claim 4, wherein said sealing ring having an end surface extending transversely of the axial direction of said body and facing toward said firing chamber, and at least a portion of said end surface of said sealing ring being exposed to the interior of said firing chamber so that explosive gases generated within said firing chamber upon the ignition of a caseless charge act directly on said portion of said end surface.

8. An explosive powder operated device, as set forth in claim 7, wherein said head overlapping said sealing ring comprises a plurality of angularly spaced radially outwardly extending projections forming grooves therebetween extending in the axial direction of said counterhammer for admitting the explosive gases into direct surface contact with said end surface of said sealing ring.

9. An explosive powder operated device, as set forth in claim 6, wherein the axis of said passage is disposed in parallel relation with the axis of said bore, and said barrel having a connecting passage extending between said bore and said firing chamber.

* * * * *